US005348377A

United States Patent [19]

Grosch

[11] Patent Number: 5,348,377

[45] Date of Patent: Sep. 20, 1994

[54] ADJUSTABLE HEIGHT TILTABLE FOOTREST

[76] Inventor: Peter T. Grosch, 1456 Rockwell Rd., Abington, Pa. 19001

[21] Appl. No.: 140,789

[22] Filed: Oct. 21, 1993

[51] Int. Cl.[5] ..... A47C 7/50

[52] U.S. Cl. ..... 297/423.45; 297/423.46; 297/261; 297/338; 108/8; 248/423

[58] Field of Search ..... 297/258, 261, 325, 329, 297/338, 344.12, 423.42, 423.45, 423.46; 108/1, 8; 248/125, 423

[56] References Cited

U.S. PATENT DOCUMENTS

| | | | |
|---|---|---|---|
| 2,083,605 | 6/1937 | Jertberg | 297/423.45 X |
| 3,606,458 | 9/1971 | Attinger | 297/423.45 |
| 3,653,715 | 4/1972 | Drabert et al. . | |
| 3,940,181 | 2/1976 | Cheek, Jr. . | |
| 4,228,745 | 10/1980 | Gale . | |
| 4,383,714 | 5/1983 | Ishida | 297/325 |
| 4,441,758 | 4/1984 | Fleischer et al. . | |
| 5,201,568 | 4/1993 | Christensen, Jr. . | |

FOREIGN PATENT DOCUMENTS

| | | | |
|---|---|---|---|
| 64675 | 8/1946 | Denmark | 108/1 |
| 1079004 | 8/1967 | United Kingdom | 297/423.45 |

OTHER PUBLICATIONS

United Stationers 1994 Catalog.
BackSaver Catalog 1993.

*Primary Examiner*—Peter R. Brown
*Attorney, Agent, or Firm*—Howson and Howson

[57] ABSTRACT

An adjustable height tiltable footrest comprises a plate having an upper surface adapted to support the feet of a human user, a base for supporting the plate and having front and rear guide surfaces which are oblique with respect to each other. The plate has roller assemblies with rollers which rest on the guide surfaces to support the plate tiltably, and the roller assemblies snap into recesses formed on the underside of the plate so that the spacing between the roller assemblies can be adjusted to vary the overall height of the plate.

11 Claims, 4 Drawing Sheets

66
68
48
46
54
60
47
49
56
52
50
44
64
38
42
62
40

ADJUSTABLE HEIGHT TILTABLE FOOTREST

BRIEF SUMMARY OF THE INVENTION

This invention relates to footrests of the type utilized by a human while in a seated position. It is specifically concerned with an improved version of a footrest, capable of vertical height and angular adjustments.

Footrests are typically used to provide greater physical comfort by supporting the feet at a height above floor level. They are often used in office environments where personnel are required to maintain a seated position for extended periods of time, and are particularly useful for people whose feet do not reach the floor. This can cause lower back strain along with soreness through thigh and calf muscle overuse. A footrest eliminates these problems by providing support for the legs, thereby relieving strain on the spine and other associated anatomy.

The flexibility of a footrest is of prime importance in successfully furnishing support to all individuals in a physically diverse population. Vertical and angular adjustments are therefore necessary in order to accommodate all individuals regardless of their sizes or shapes. An effective footrest also needs to be adaptable to the user's changing activities which may include leaning forward and reclining.

This concern over flexibility has led to numerous alternative designs. One adjustable footrest, described in U.S. Pat. No. 3,940,181, is appropriately termed an "Adjustable Hassock". This basic design provides for angular adjustments by equipping a seat with a downwardly extending brace having teeth which selectively catch on a static base.

U.S. Pat. No. 3,653,715 describes a footrest which has the capability of height and angle adjustment. It employs two pivoted leg members which are independently adjustable. Another footrest, described in U.S. Pat. No. 5,201,568, accomplishes angular adjustment of an elliptically shaped foot pad by eccentrically pivoted legs. U.S. Pat. No. 4,441,758 describes an angularly adjustable footrest utilizing a rack and pinion mechanism. U.S. Pat. No. 4,228,745 describes a footrest which can be adjusted both in height and slope by a screw mechanism.

There is another category of tiltable footrest utilizing a plate having front and rear rollers provided on each of its side edges. The plate is supported by a base frame having a pair of tracks, each in the shape of an inverted "V" on either side of the plate. The rollers ride on the tracks, with the front and rear roller on each side of the plate being situated on opposite sides of the peak of the inverted "V", so that the plate can be tilted by the application of foot pressure. This type of footrest is tiltable through an adequate range, but lacks a height adjustment capability.

The principal object of this invention is to provide a highly flexible footrest with a range of adjustment that effectively accommodates disparate users. Still another object of the invention is to provide an adjustable footrest which is simple and inexpensive to manufacture. It is also an object of the invention to promote ease of use, stability, durability, and reliability. Another object of the invention is to produce a secure footrest not subject to accidental adjustments.

The adjustable height, tiltable footrest in accordance with the invention comprises a plate, having first and second side edges, and an upper surface adapted to support the feet of a human user. A base for supporting the plate while permitting tilting movement thereof is provided with front and rear guide surfaces which are oblique with respect to each other. These guide surfaces cooperate with first and second rollers, secured to the plate and spaced from each other. These rollers support the plate on the guide surfaces. The first roller rests on the front guide surface, and the second roller rests on the rear guide surface. Because the front and rear guide surfaces are oblique with respect to each other, the plate can be tilted by movement of the rollers on the guide surfaces. The height of the plate can be adjusted by adjusting the spacing between the rollers, which preferably snap into grooves provided in the underside of the plate.

Further objects, details and advantages of the invention will be apparent from the following detailed description, when read in conjunction with the drawings.

DETAILED DESCRIPTION

Figures 1, 2:
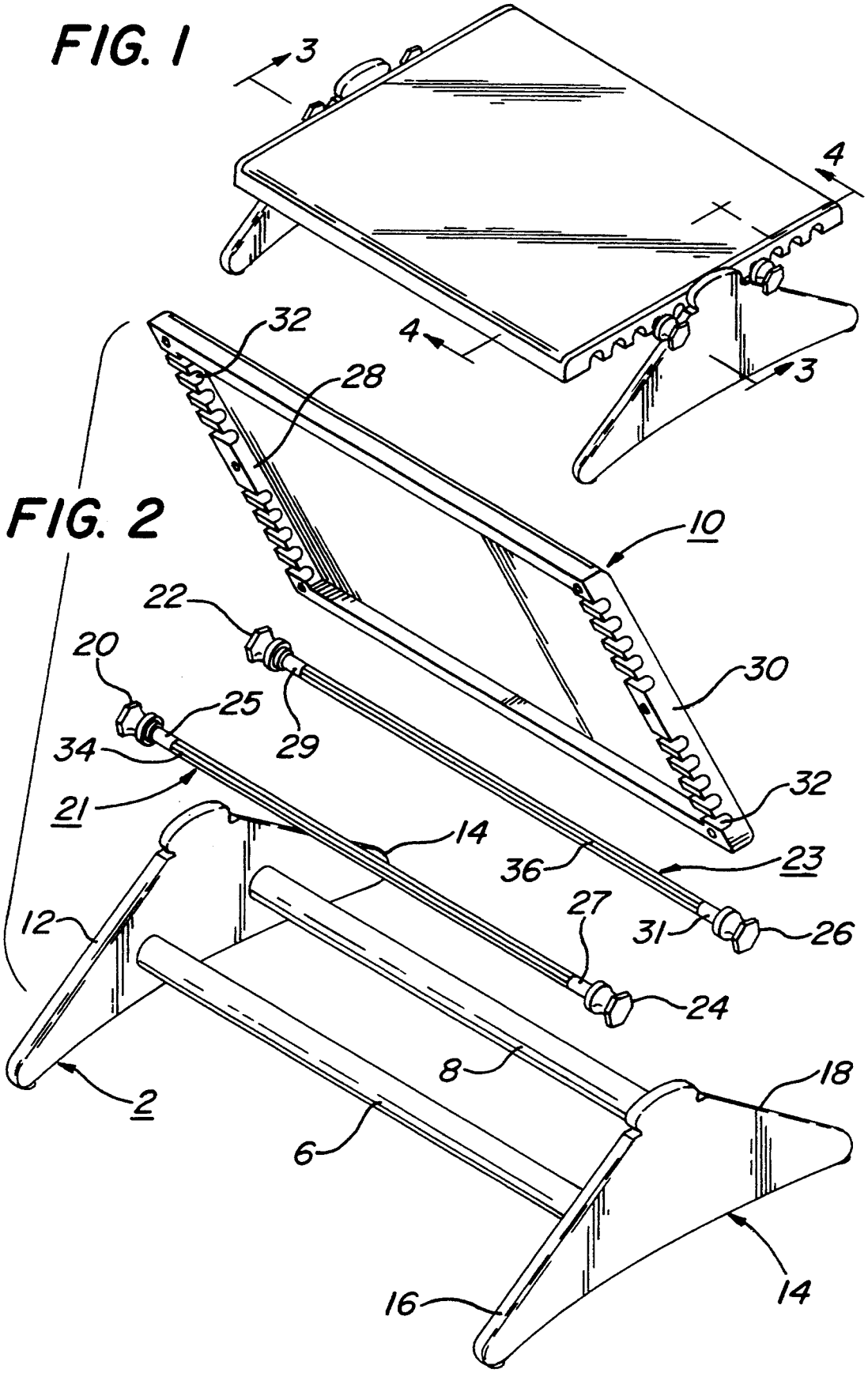
FIG. 1 is a top perspective view of a first embodiment of the adjustable height tiltable footrest in accordance with the invention.
FIG. 2 is an exploded view of the adjustable height tiltable footrest.

The adjustable height tiltable footrest shown in FIGS. 1, 2, 3, and 4 comprises a base consisting of left and right, generally triangular, plates 2 and 4, rigidly connected together by braces 6 and 8. A plate 10 having a generally planar upper surface is supported on the upper edges 12 and 14 of plate 2, and the corresponding upper edges 16 and 18 of plate 4, by roller assemblies 21 and 23.

Figure 4:
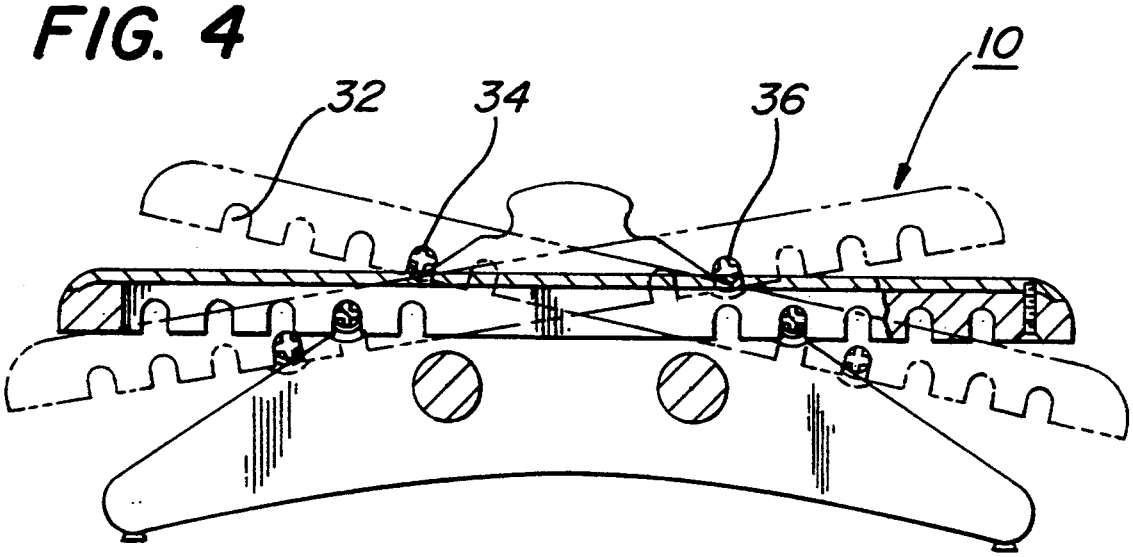
FIG. 4 is a sectional view taken on surface 4—4 of FIG. 1 with various adjustment positions being indicated in chain lines.

Roller assembly 21 comprises rollers 20 and 24, rigidly connected by member 34, while roller assembly 23 comprises rollers 22 and 26 rigidly connected by member 36. Each member 34 and 36 has a uniform cross-section throughout its length, which is preferably star shaped, as shown in FIG. 4. Rollers 20, 22, 24, and 26 have annular grooves for engagement with upper edges 12, 14, 16, and 18 of the base plates. The rollers have circular, cylindrical sections 25, 27, 29, and 31, removably insertable into recesses 32 provided in depending side edge members 28 and 30, which extend along opposite edges of the plate 10.

The roller assemblies are preferably unitary, but can be made by assembling separate elements, e.g. the rollers, and the connecting members. The rollers and connecting members can be rigidly attached or relatively rotatable.

Side edge members 28 and 30 are rigidly attached to the lower side of the plate 10 by screws, so that the side edge members 28 and 30 protrude downwardly from the lower face of the plate. Identical rows of recesses 32 provided in the side edge members 28 and 30 are then positioned to open toward the floor and away from the plate 10, as shown in FIGS. 2 and 4. Side edge member appendages forming the recesses 32 are resilient and thus capable of withstanding the compressive stress associated with insertion of the roller assemblies without permanent deformation.

Figure 3:
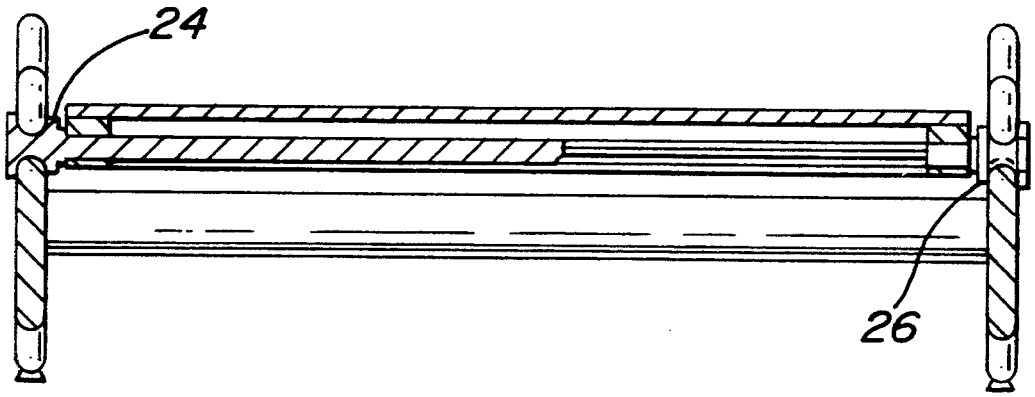
FIG. 3 is a sectional view taken on plane 3—3 of FIG. 1.

The annular grooves of the rollers 20, 22, 24, and 26 are proportioned and related to one another so that they can rest on, and travel longitudinally along, the upper edges 12, 14, 16, and 18 of the triangular plates, as shown in FIGS. 3 and 4. Upper edges 12 and 14 of plate 2 are oblique with respect to each other, with front edge 12 inclined upwardly, proceeding from the front of the base toward the rear, and rear edge 14 inclined downwardly. Upper edges 16 and 18 of plate 4 are parallel to edges 12 and 14 respectively. The height of a roller relative to the floor will therefore vary as it moves longitudinally along its associated upper edge.

The overall height of the plate 10 relative to the floor is dependent upon which recesses 32 hold the roller assemblies 21 and 23. Rollers 20, 22, 24, and 26 sit lower on the corresponding upper edges 12, 14, 16, and 18 of the base plates as the distance separating the roller assemblies increases. This will consequently decrease the height of the plate 10 relative to the floor.

Roller assemblies are inserted into the recesses 32 by bringing the circular, cylindrical sections of the rollers into contact with side edge appendages forming recesses 32 and applying pressure, to the roller assemblies, perpendicular to the lower surface of the plate 10. The circular, cylindrical sections come into direct contact with corresponding cylindrical portions of the walls of the recesses 32.

When the circular, cylindrical sections are snapped into place movement of the roller assemblies 21 and 23 is restricted to rotation. Axial movement is prevented by engagement of the rollers with the faces of side edge members 30 and 32. Lateral movement is prevented by the grasping action of the resilient recess walls on the circular, cylindrical sections of the rollers. The plate will thus follow the roller assemblies 21 and 23 along the upper edges 12, 14, 16, and 18, so that its pitch relative to the floor may be varied, as shown in FIG. 4.

The overall height of the plate 10 relative to the floor can be adjusted by removing the roller assemblies from the their recesses and inserting them into other selected recesses so that they are spaced either closer together or further apart.

Figure 5:
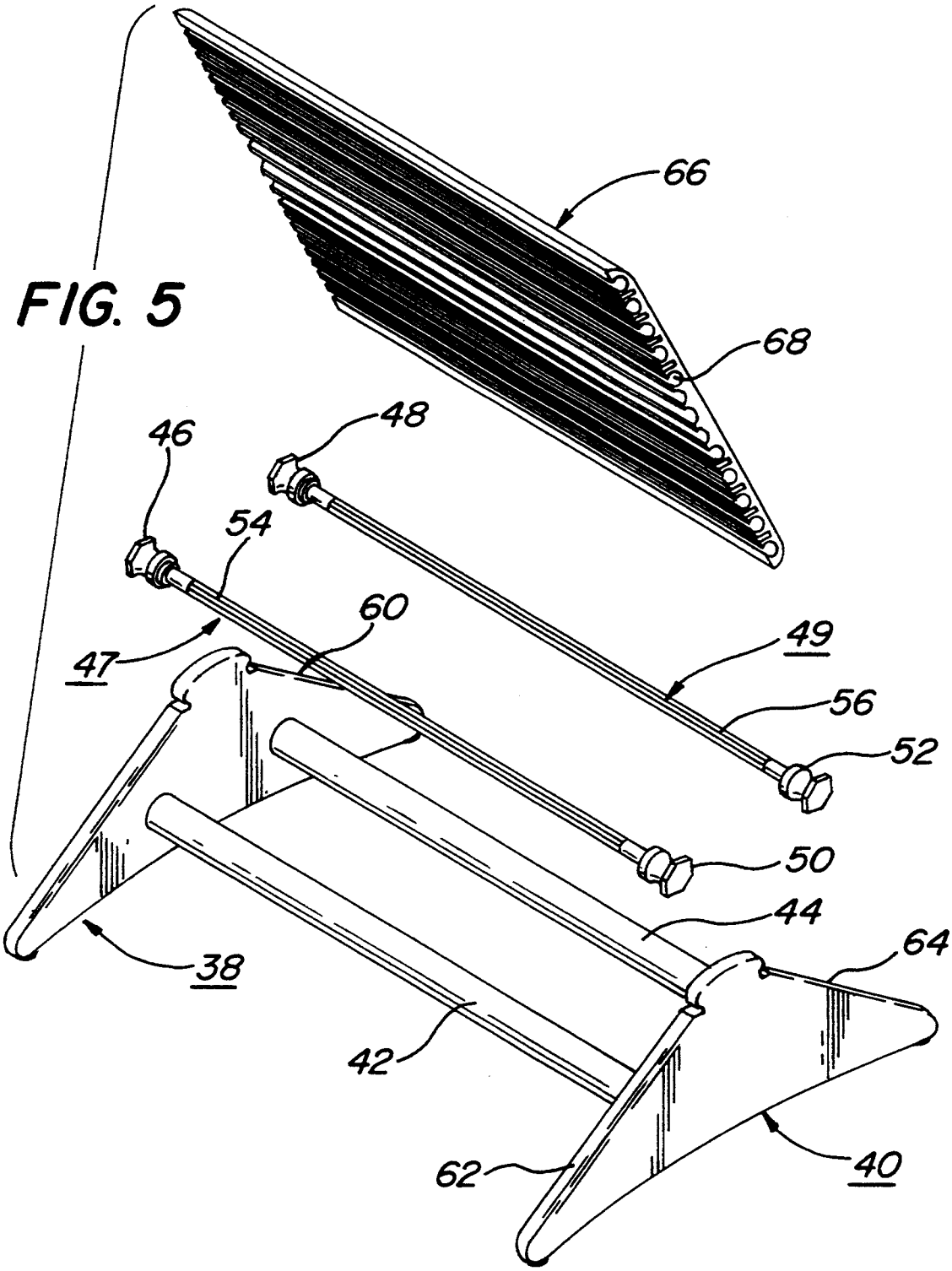
FIG. 5 is an exploded view of a second embodiment of the adjustable height tiltable footrest.
Figure 6:
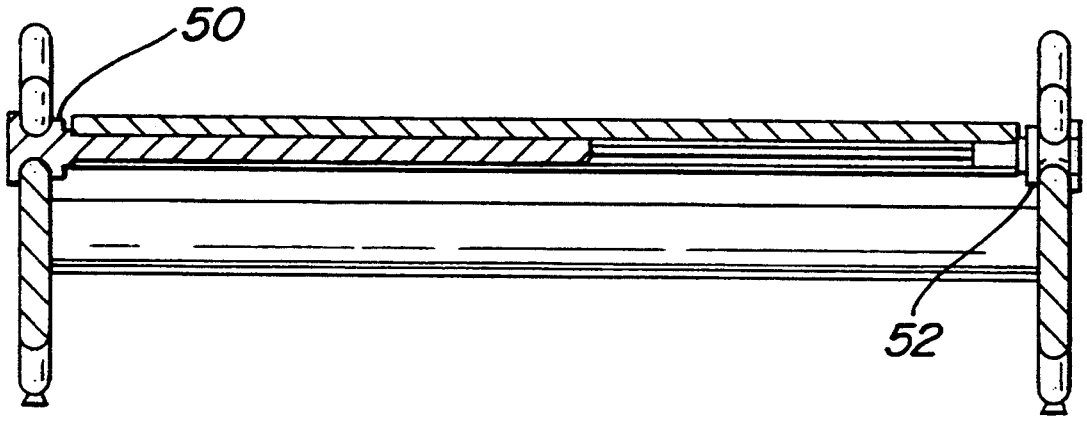
FIG. 6 is a sectional view of the footrest of FIG. 5, corresponding to FIG. 3.
Figure 7:
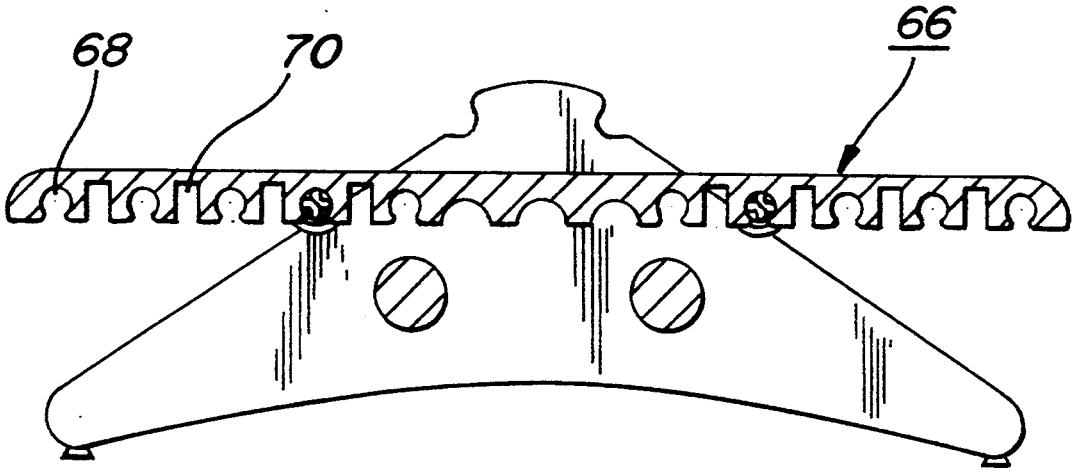
FIG. 7 is a sectional view of the footrest of FIG. 5, corresponding to FIG. 4.

The second embodiment of the footrest, shown in FIGS. 5, 6 and 7, comprises base plates 38 and 40, braces 42 and 44 and roller assemblies 47 and 49 having rollers 46, 48, 50, and 52 with connecting members 54 and 56. The base plates have upper edges 58, 60, 62, and 64, all of which are identical in shape and function to those of the first embodiment. The plate 66, having a generally planar upper surface, is likewise supported on the upper edges 58 and 60 of plate 38, and the corresponding upper edges 62 and 64 of plate 40, by the roller assemblies 47 and 49.

The roller assemblies 47 and 49 are removably insertable into recesses 68 provided in the plate 66. The plate may be formed by extrusion so that parallel rows of recesses 68 extend across the entire width of the lower surface of the plate 66, as shown in FIGS. 5 and 7. The recesses 68 are positioned to open toward the floor, thereby allowing entry of the roller assemblies 47 and 49 when pressure is applied to the roller assemblies toward the lower surface of the plate 66. Because the plate extruded, it is comparatively inexpensive to manufacture. However, its cross-sections are uniform and roller assembly receiving recesses formed in the plate would be stiff, causing difficulty in snapping the roller assemblies into place. In order to increase the resilience of the roller assembly receiving recesses 68, additional recesses shown in FIG. 7, are provided so that recesses 68 are bounded by relatively thin flexible walls. Preferably, the connecting members 54 and 56 are formed so that their maximum traversional dimension is less than the diameter of the circular, cylindrical portion of the rollers. Therefore a clearance is provided between members 54 and 56 and the walls of the recesses to avoid unnecessary friction.

The footrest in accordance with the invention is easily and inexpensively manufactured, and can be adjusted easily by the user to position the plate at a desired height, over a wide range. With outboard rollers, the plate can be positioned close to the floor and yet adjusted in pitch over a wide range. The connecting members between the rollers on opposite sides of the plate rigidify the rollers so that the plate can support substantial loads.

Various changes may be made to the described embodiments. For example, roller assemblies comprising rollers capable of rotating on the ends of their connecting members can be used. Vertical and angular adjustments may also be accomplished with non-triangular base plates. Base plates may be manufactured in various shapes which provide upper edges of varying height. For example, concave base plates may be used.

The connecting members need not be star shaped, and may be formed with various other cross-sectional contours.

Still other modifications, which will occur to persons skilled in the art, may be made without departing from the scope of the invention as defined in the following claims.

I claim:

1. An adjustable height, tiltable footrest comprising:

a plate having upper and lower surfaces, the upper surface being adapted to support the feet of a human user; base means comprising track means with front and rear guide surfaces, the front guide surface being in non-parallel relationship to the rear guide surface;

first support means on said plate for engaging, and moving on, the front guide surface, and second support means on said plate for engaging, and moving on, the rear guide surface; and means, on the plate, for mounting said first and second support means on the plate in any selected one of multiple, fixed, spaced, relationships to each other;

said plate being free to tilt as the first and second support means move on said front and rear guide surfaces while being mounted on the plate in fixed relationship to each other;

whereby concurrent movement of the first support means on the front guide surface, and the second support means on the rear guide surface, results in a change in the pitch of the and alteration of the spacing between the first and second support means adjusts the height of the plate.

2. An adjustable height, tiltable footrest comprising:

a plate having first and second side edges, and an upper surface adapted to support the feet of a human user;

base means for supporting the plate while permitting tilting movement thereof, the base means having a front guide surface, and a rear guide surface;

first and second roller means, secured to the plate and spaced from each other, for supporting the plate on the guide surfaces, the first roller means resting on the front guide surface and the second roller means resting on the rear guide surface, and the front and rear guide surfaces being in non-parallel relationship to each other so that the plate can be tilted by movement of the roller means on the guide surfaces; and means on said plate for adjusting the spacing between the first and second roller means, whereby the height of the plate can be adjusted.

3. An adjustable height, tiltable footrest according to claim 2 wherein the base means comprises a panel having upper edges, and the front and rear guide surfaces are constituted by the upper edges of said panel.

4. An adjustable height, tiltable footrest according to claim 3 wherein said panel is substantially in the form of a triangle, and the front and rear guide surfaces are constituted by two sides of the triangle.

5. An adjustable height, tiltable footrest according to claim 2 wherein the base means comprises a pair of panels having upper edges, and the front and rear guide surfaces are constituted by the upper edges of the panels.

6. An adjustable height, tiltable footrest according to claim 5 in which said panels are substantially in the form of first and second triangles, and in which the front guide surfaces are constituted by a first side of the first triangle and a first side of the second triangle, and the second guide surfaces are constituted by a second side of the first triangle and a second side of the second triangle.

7. An adjustable height, tiltable footrest according to claim 2 wherein the plate has a lower surface with multiple recesses to receive the roller means, the recesses having resilient walls such that the roller means can be snapped into selected recesses.

8. An adjustable height, tiltable footrest according to claim 2 wherein the plate is provided with recesses along the first and second side edges of the plate to receive the roller means, the recesses having resilient walls such that roller means can be snapped into selected recesses.

9. An adjustable height, tiltable footrest according to claim 2 wherein the plate is provided with grooves extending across its entire width, from the first side edge to the second side edge, such that the roller means can snap into the grooves.

10. An adjustable height, tiltable footrest according to claim 2 wherein the base means comprises a pair of panels having upper edges, and the front and rear guide surfaces are constituted by the upper edges of the panels, and wherein separate roller means rest on the front and rear guide surfaces, the first roller means comprising a pair of rollers resting on the front guide surfaces, and the second roller means comprising a pair of rollers resting on the rear guide surfaces.

11. An adjustable height, tiltable footrest according to claim 10 wherein the rollers of the first roller means are attached by rigid connecting means maintaining them a fixed distance apart, and the rollers of the second roller means are also attached by rigid connecting means maintaining them a fixed distance apart.

* * * * *

UNITED STATES PATENT AND TRADEMARK OFFICE

CERTIFICATE OF CORRECTION

PATENT NO. : 5,348,377

DATED : September 20, 1994

INVENTOR(S) : Peter T. Grosch

It is certified that error appears in the above-identified patent and that said Letters Patent is hereby corrected as shown below:

Colum 3, line 41, after plate insert --10--;
Colum 4, line 2, after plate insert --is--;
Colum 4, line 8, after "recesses" insert --70--;
Colum 4, line 65, before "and" insert --plate--.

Signed and Sealed this

Twenty-second Day of November, 1994

*Attest:*

Bruce Lehman

BRUCE LEHMAN

*Attesting Officer*

*Commissioner of Patents and Trademarks*